United States Patent [19]

Ball

[11] Patent Number: 4,738,167

[45] Date of Patent: Apr. 19, 1988

[54] TOOL-EXTENDER DEVICE

[76] Inventor: Kenneth F. Ball, 570 Scioto St., Urbana, Ohio 43078

[21] Appl. No.: 900,830

[22] Filed: Aug. 27, 1986

[51] Int. Cl.[4] ..... B25B 13/02

[52] U.S. Cl. ..... 81/124.2; 81/177.2; 81/177.85; 81/184

[58] Field of Search ..... 81/121.1, 124.2, 124.7, 81/125, 177.1, 177.2, 177.85, 180.1, 184

[56] References Cited

U.S. PATENT DOCUMENTS

| | | | |
|---|---|---|---|
| 1,456,290 | 5/1923 | Tell | 81/177.85 |
| 2,985,208 | 5/1961 | Hibbard et al. | 81/184 |
| 3,010,346 | 11/1961 | Kulp | 81/124.2 |

FOREIGN PATENT DOCUMENTS

| | | | |
|---|---|---|---|
| 2092042 | 1/1982 | United Kingdom | 81/436 |

*Primary Examiner*—Frederick R. Schmidt

*Assistant Examiner*—Judy J. Hartman

*Attorney, Agent, or Firm*—Becker & Becker, Inc.

[57] ABSTRACT

An extend-a-tool device including a main body integral with a pair of downwardly extending members having a cut out portion therebetween into which a handle of a wrench as well as handles of a pair of pliers can be inserted in a wedged-in manner. The main body and pair of downwardly extending members can have a substantially squared configuration and also can have a substantially cylindrical configuration. The cut out portion has a long-oval or egg-shaped configuration with edges located toward each other to restrict a bottom opening whereas the axially opposite openings of the cut out portion are adapted to receive a handle of the wrench as well as handles of pliers therein for a positive drive connection even when the extend-a-tool device is at an angle to the axis of the wrench, handles of pliers and other tools.

5 Claims, 2 Drawing Sheets

TOOL-EXTENDER DEVICE

BACKGROUND OF THE INVENTION

1. Field of the Invention

The present invention relates to a tool-extender or extend-a-tool device insertable between a handle portion of one tool such as an open end wrench, box wrench, combination or adjustable wrench, "channelock" pliers, pipe wrench, ratchet tool as well as a handle of a further tool; to obtain leverage and mechanical advantage in tightening or loosening of a nut or bolt as well as a threaded pipe when a wall obstruction laterally of one end of a handle of the tool makes access space limited and difficult for mechanical advantage in applying leverage and tightening or loosening force as to the nut, bolt or pipe for example.

2. Description of the Prior Art

Various hand tools have been known over the years and adaptability thereof to employment in various situations and uses can vary considerably. Space available for manipulation of tools may be rather limited and cramped so that a need exists for solving the problem of space limitations while at the same time facilitating manipulation and tightening or loosening of nuts and bolts.

The known prior art relates mostly to apparatus for manipulating nuts and bolts or wingnuts for example directly and as an example of such prior art there can be reference made to U.S. Pat. No. 4,357,845—Cornia dated Nov. 2, 1982 which discloses a very specific apparatus for manipulating wingnuts. This apparatus for manipulating wingnuts serves to facilitate installation and removal of wingnuts from marginally accessible locations but there is no provision of an added intermediate tool between the wingnut and the apparatus of U.S. Pat. No. 4,357,845—Cornia. The use of a pair of pliers or box wrench or open end wrench for example would not be encountered with the apparatus of U.S. Pat. No. 4,357,845—Cornia. The engagement of ears of a wingnut rather than handles of a pair of pliers for example would differ as to the problems encountered and presented therewith.

U.S. Pat. No. 3,086,414—Nardi dated Apr. 23, 1963 makes no provision for use of any combination wrench on wingnuts of varying sizes nor for keeping the wingnut in communication with the wrench to allow axial alignment to be achieved in difficult access situations. Thus the problem of difficult access situations seems to be one that has been considered previously for direct tool engagement as to a nut but not necessarily as to engagement of an extend-a-tool device relative to another tool prior to engaging the nut, bolt or screw for example to be fastened or loosened therewith. The Nardi Patent has a slotted-skirt configuration of a combination wrench or tool having a squared portion 24 at one end thereof.

A Petcock drain tool having a non-flexible shaft according to U.S. Pat. No. 3,010,346—Kulp also can be noted for a cup-shape socket with an undercut slotted configurations of openings and rectangular slots identified therewith. This undercut slotted configuration generally would seem to be applicable only to specific structures rather than representing an intermediate extend-a-tool apparatus serving a need for an intermediate connection in limited access space.

Also, reference can be made to prior art of U.S. Pat. No. 2,445,905—Busby dated July 28, 1948 which discloses a rigid jaw wrench with an insertable auxiliary socket. U.S. Pat. No. 2,642,105—Alliano dated June 16, 1953 discloses a driving tool for eyescrews. U.S. Pat. No. 2,660,080—DeKam dated Nov. 24, 1953 discloses an internal wrench with a fastener retention means. U.S. Pat. No. 2,940,344—Taylor dated June 14, 1960 discloses a radiator cap removing wrench. U.S. Pat. No. 3,253,626—Stillwagon dated May 31, 1966 discloses a magnetic tool. U.S. Pat. No. 2,987,080—Chandler et al dated June 6, 1961 discloses a draincock tool having bayonet-like undercut portions for engaging a draincock having a rotating handle.

SUMMARY OF THE INVENTION

An object of the present invention is to provide an extend-a-tool device including an eight-point square hole in one end of a cup-shaped member having a downwardly extending skirt portion which is cut out in diametrically opposite locations to provide a bulging slot adapted to receive a handle of another tool such as a pair of pliers, socket wrench, open end wrench, gripper as well as a ratchet wrench and square-drive deep socket for application in close quarters or limited space availability both around the wrench and bolt area.

BRIEF DESCRIPTION OF THE DRAWINGS

This object, and other objects and advantages of the present invention, will appear more clearly from the following specification in conjunction with the accompanying drawings, in which.

DESCRIPTION OF THE PREFERRED EMBODIMENTS

Figure 1:
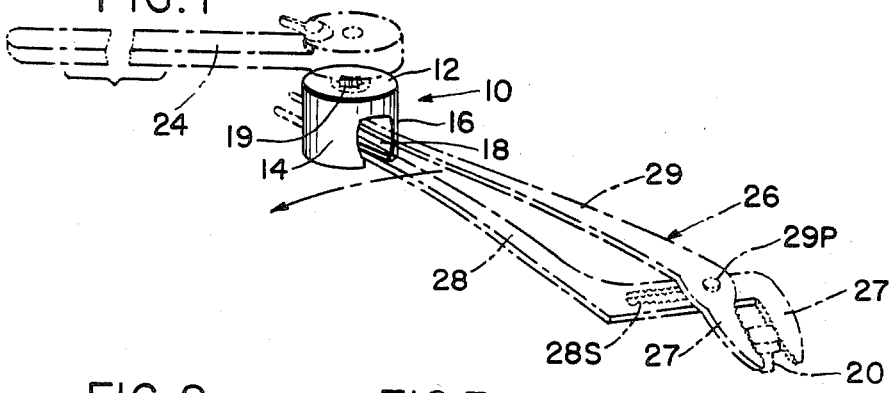
FIG. 1 is a perspective view of a tool-extender device for operative positioning between a ratchet tool and a handle of a further tool shown as an open end wrench, box wrench, combination or adjustable wrench or "channelock" pliers.
Figure 2:
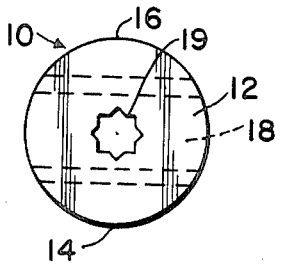
FIG. 2 is a top view of the tool-extender device in FIG. 1.
Figure 3:
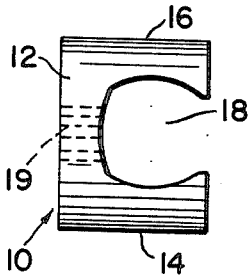
FIG. 3 is a side elevational view of the tool-extender device.
Figure 4:
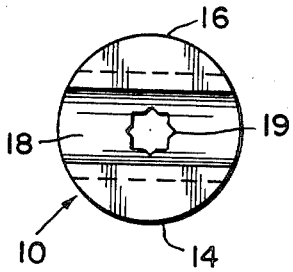
FIG. 4 is a bottom view of the tool-extender device.
Figure 5:
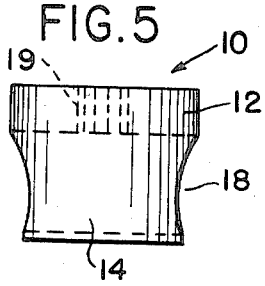
FIG. 5 is a side elevational view of the tool-extender device.
Figure 6:
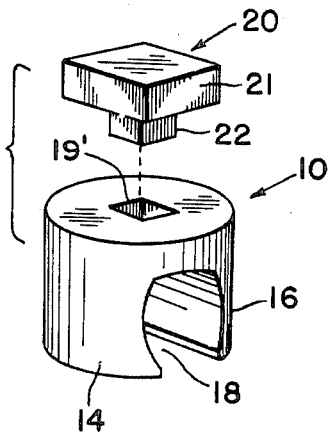
FIG. 6 is a perspective exploded view of the tool-extender device with a variable size top insert.
Figure 7:
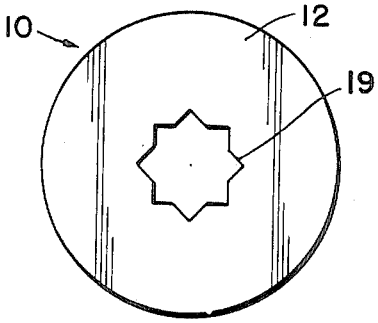
FIG. 7 is top view of a tool-extender device having an eight point, double-square opening for the top inserts.

Referring now to the drawings in detail, FIG. 1 is a perspective view showing an extend-a-tool device generally indicated by reference numeral 10 including a main body 12 and a pair of downwardly extending members 14 and 16 as well as a cut out portion 18 located diagonally or transversely through the extend-a-tool device 10. The main body 12 has a central opening or depression in a double-square or eight-point configuration 19. Details of this extend-a-tool device 10 can be seen in views of FIGS. 2, 3, and 4 as well as 5. FIG. 6 shows the opening or depression 19 with a square configuration 19' rather than the double-square or eight-point configuration 19 illustrated in FIG. 7. FIG. 6 also shows a plug unit 20 having a head portion 21 and a socket portion 22 insertable in the opening, recess or depression 19' for example. This plug insert 20 can have various sizes and/or shapes depending upon the tool such a ratchet 24 of FIG. 1 as well as a non-illustrated open end wrench, box wrench and combination or adjustable wrench or even a "channelock" pliers that may be used to engage the plug insert 20. Also such a pair of pliers or "channelock" pliers generally indicated by numeral 26 including a gripper portion 27 and a pair of handles 28 and 29 insertable in the cut out portion 18 can be provided with the pliers 26. The cut out portion 18 can have a horseshoe or more squared U-shape illustrated in FIGS. 1 and 3 for example as well as in FIG. 6. If a ratchet wrench 24 is employed there can be applied an operational torque or twisting movement to the extend-a-tool device 10 having the downwardly extending members 14, 16 that engage the handles 28, 29 of the pliers 26 as to the plug insert 20 outlined in FIG. 1 and shown in greater detail in FIG. 6.

The plug insert 20 can be made separable or also can be made integral with the main body 12 as to the opening, recess or depression 19'. If a square configuration of the opening 19' is provided there is apparent that only a 90° angle variation can be provided for each engagement position of the wrench 24 if an open end, box wrench and the like is applied to the insert plug 20 as to the main body 12. An eight-point configuration of the opening, recess or depression 19 results in the advantage of having a 45° degree angle for shifting or changing positions as to engagement of the wrench.

The extend-a-tool device and plug insert either separable or integral therewith can be made of 80 carbon steel and tempered for hardness. The cut out portion in a horseshoe or more squared U-shape configuration can be made concave so as to insure engagement of the handles 28, 29 of the pliers 26 transverse therein as represented in FIG. 1 of the drawings.

Figure 8:
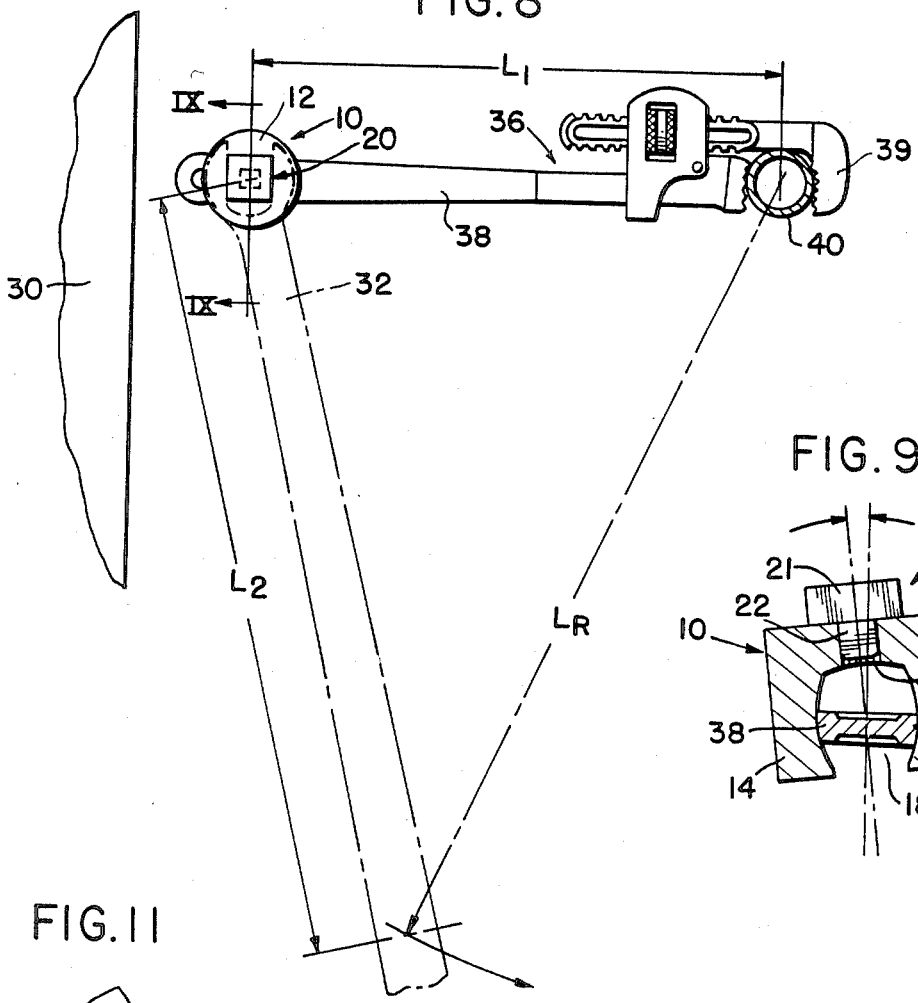
FIG. 8 is a plan view of a tool-extender device for operative positioning between an open end wrench and an adjustable-pipe-wrench handle encountering a wall or obstruction laterally thereof.
Figure 9:
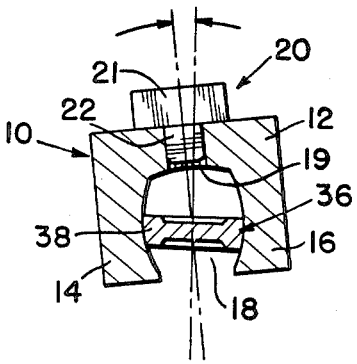
FIG. 9 is a sectional view taken along line IX—IX in FIG. 8 illustrating a positive drive arrangement even though extender is at an angle to the axis of the tool handle.

FIG. 8 shows a plan view of a wall obstruction 30 relative to which an extend-a-tool device 10 with a main body 12 and plug unit or insert 20 engage by an open end wrench 32 can be fitted with respect a conventionally adjustable pipe wrench 36 having a handle 38 inserted in the cut out portion 18 as best illustrated in FIG. 9 of the drawings. The cut out portion 18 in FIG. 9 has a substantially U-shaped configuration which can be designated as a long oval or egg-shaped configuration so as to receive the opposite edges of the handle 38 of the pipe wrench 36 therein. The curved sides of the cut out portion 18 allow angular placement or engagement of the handle 38 as to the opposite peripheral surfaces engaged by the edges of the handle 38 as apparent in FIG. 9. The pipe wrench 36 can have the adjustable head portion or jaw 39 thereof engage a pipe 40 as illustrated in FIG. 8. The use of the extend-a-tool device 10 even with a square plug unit 20 allows engagement of an open end wrench or box wrench with respect to the plug unit 20 in close quarters where limited access space is involved although allowing the extend-a-tool device to increase leverage between the wrench 32 and the pipe wrench 36 for example.

Figure 11:
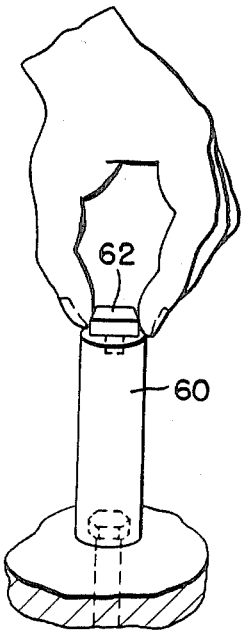
FIG. 11 is a fragmentary perspective view of a portion of the tool-extender device fitted with an insert axially alinged with respect to each other.
Figure 10:
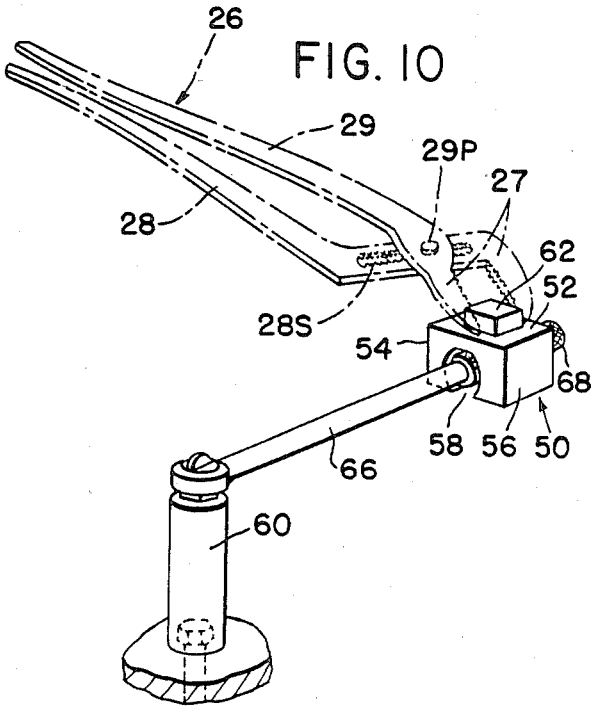
FIG. 10 is a perspective view of a tool-extender device operatively positioned between an open end wrench, adjustable gripper or pliers and a ratchet wrench or square-drive application for close quarters or limited space availability both around the wrench and bolt area.

FIG. 10 illustrates the extend-a-tool device 50 having a squared main plate portion 52 as well as downwardly extending members 54, 56 on opposite sides of a cut out portion 58. The view of Figure 11 also illustrates a substantially cylindrical body member 60 engagable with an insert 62 optionally added to the top of the cylindrical body member 60. A ratchet or square drive wrench 66 is illustrated in FIG. 10 and includes a handle 68 which fits transversely into the cut out portion 58 having the plug unit 62 engage by grippers 27 of pliers 26 having handles 28, 29 therewith. The handles 28, 29 are adjustable with respect to each other via a serrated slot **28*s* and pin 29*p* as represented in FIG. 10. This adjustment capability is applicable also as to the pliers 26 illustrated in FIG. 1. There is to be noted that as represented in FIG. 11, the cylindrical body member 60 could be used for finger tightening with a square insert plug 64 at the top where otherwise a cylindrical surface of the cylindrical body member 60 would be too slippery. Similarly the wrench 66 and pliers 26 can provide driving engagement of the cylindrical body member 60 as established via the extend-a-tool device with a squared configuration as illustrated in FIG. 10** of the drawings.

FIG. 8 includes designation of distances by arrows labeled $L_1$ for the wrench 36 as well as $L_2$ for the wrench 32 which can be an open end wrench or adjustable wrench as well as a channelock pliers or even a tool driver or another pipe wrench with the result in triangulation effect of the hypotenuse of the triangle $L_R$ to represent the resultant lever arm which is greater than the length of the pipe wrench 36 designated by the reference numeral $L_1$. The illustration of FIG. 9 shows that there is a positive drive even when the extend-a-tool device engaged by the handle 38 of the wrench 36 is at an angle to the axis of the tool. The illustration of FIG. 9 represents a section taken along line IX—IX in FIG. 8 of the drawings.

There is quite apparent that where previously there may have been used a pipe to lengthen a handle of a wrench by slipping a cylindrical pipe over the end of the handle of such wrench, there can now be added leverage gain by triangulation as represented in FIG. 8 while at the same time being able to operate and work in very limited access space by provision of the extend-a-tool device according to the present invention. The concave configuration of the cut out portion 18 is such that the downwardly extending members 14, 16 are not only stronger but also will grip better as to the handles of a pair of pliers or the handle of a pipe wrench for example. The extend-a-tool device itself can be made of example in three different sizes including a hand tool size to accommodate a driving relationship in a range of $\frac{3}{8}''$ as well as $\frac{1}{2}''$ and $\frac{3}{4}''$ drive; also a monkey wrench as well as a pipe wrench can be used with the difference existing in the manner of adjustment of the monkey wrench and the pipe wrench jaw in the well known manner. The lengthening of the lever arm via the arm of the wrench occurs by not having the lengthening in the same axis as previously employed when a straight cylindrical pipe was fitted over an end of a handle of a wrench whereas now the extend-a-tool device 10 makes it possible to offset the triangle location of the lengthened "effective" lever arm $L_R$ to one side of the location where the tightening or loosening of a bolt or nut is to occur. The box-shaped or egg-shaped configuration rather than a round hole for the cut out portion 18, 58 respectively is preferred. The extend-a-tool is a hand tool rather than being machine made. In the event the extend-a-tool device is made square rather than round, the overall weight thereof is heavier and stronger when needed. The extend-a-tool device 10, can be made as a casting and also can be made as a solid piece of metal which is machined and milled as well as ground if necessary to the specific configuration of the main body 12, 52 respectively as well as the cut out portion 18, 58 respectively.

The present invention is, of course, in no way restricted to the specific disclosure of the specification and drawings, but also encompasses any modifications within the scope of the appended claims.

What I claim is:

1. An extend-a-tool device used as an auxiliary supplement to extend effective lever-arm length of a handle of a tool including a wrench, a pair of pliers, box-end wrench, open end wrench, pipe wrench as well as another tool driver with the extend-a-tool device positioned intermediate the tool and the tool driver, with a tool, said device in combination consisting of:

a solid main body having a top and bottom with an axis therebetween, said top having an auxiliary part extending axially upwardly thereof for application of twist force thereto;

said main body including integrally therewith means that form a substantially oval-shaped cavity cut through transversely to the axis in said main body as a cut out portion having opposing walls with an undercut that forms oppositely curved edges at opposite axial ends of said oval-shaped cavity as a means for engagement and opposite axial ends transversely located at one end of said main body to form a downwardly extending arrangement including configuration open at the opposite axial ends thereof as well as along the bottom of said main body to receive the handle of a cross-member tool engageable with respect to substantially diagonally oppositely located curved edges at the axially opposite ends of said oval-shaped cavity as said means for engagement via an intermediate location relative to another tool as to said main body such that a triangulation effect during application of said twist force to said main body results in a gripping engagement with said curved edges brought about for application of turning pressure therebetween via the extend-a-tool device in effect lengthening the effective lever arm length to increase leverage for tightening and loosening of a bolt, nut as well as a pipe engageable by a pipe wrench and used as the auxiliary supplement in conjunction with although without replacing other tools to add leverage to existing tools of insufficient length to break loose any tight threaded connection that is being worked, said cut out portion being with opposite axially open ends through which a wrench handle as well as handles of a pair of pliers can be inserted subject to edge retention of such wrench handle and handles of a pair of pliers by lower corners of oppositely curved edges of said cut out portion extending toward each other to decrease an opening along the bottom of the cut out portion whereby the wrench handle and handles of the pair of pliers are kept from movement downwardly out of the cut out portion even when a wall obstruction is encountered which would limit access space and also limit the length of leverage without the use of the extend-a-tool device whereby a further wrench is to engage said means for engagement of another tool having a predetermined length taken with the length of leverage as an extender collectively to form an overall triangulation effect via a resultant lever arm configuration collectively therewith which is longer than the leverage without the use of the extend-a-tool device in an intermediate location so that there is a positive drive connection angularly offset via the extend-a-tool device that is located at an angle to an axis of one tool relative an axis of another tool.

2. An extend-a-tool device in combination according to claim 1 in which said auxiliary part has an overall body configuration which is square and separate from said main body and from other tools to fit complementary as used in conjunction with a square recess in the top of said main body for engagement and application of twist force from a tool, to said main body to achieve leverage therewith against the cross-member tool.

3. An extend-a-tool device in combination according to claim 1 in which said main body is cylindrical along outer periphery of the downwardly extending arrangement open at the opposite axial ends as well as along the bottom to receive the cross-member tool transversely in engagement against the oppositely curved edges.

4. An extend-a-tool device in combination according to claim 1 further having an eight-point opening in the top of the main body to make possible 45° angle shift in positioning of engagement of that driver tool relative to the extend-a-tool device.

5. An extend-a-tool device in combination according to claim 1 wherein said means for engagement of another tool is an auxiliary part provided as a separable plug insert that fits in an opening in said top of the main body and is removable therefrom for accommodation of differing tool drivers relative thereto.

* * * * *